US005842602A

United States Patent [19]

Pierpoint

[11] Patent Number: 5,842,602

[45] Date of Patent: Dec. 1, 1998

[54] IRRITANT DISPENSER AND METHOD

[76] Inventor: James W. Pierpoint, 4610 Yuma Ct., Winston Salem, N.C. 27107

[21] Appl. No.: 48,801

[22] Filed: Mar. 26, 1998

[51] Int. Cl.[6] ..... B65D 83/22

[52] U.S. Cl. ..... 222/1; 222/192; 222/402.1; 222/402.11; 222/153.03; 222/153.11; 222/162; 222/504; 463/47.4; D22/117

[58] Field of Search ..... 222/1, 175, 153.03, 222/192, 153.11, 162, 402.1, 402.11, 325, 402.15, 504; 463/47.2, 47.4; D22/117

[56] References Cited

U.S. PATENT DOCUMENTS

| | | | |
|---|---|---|---|
| D. 334,790 | 4/1993 | Jaramillo | D22/117 |
| 3,385,601 | 5/1968 | Black | 463/47.4 |
| 3,635,374 | 1/1972 | Anketell | 222/78 |
| 3,730,390 | 5/1973 | Adrian et al. | 222/79 |
| 3,756,467 | 9/1973 | Anketell | 222/78 X |
| 4,044,922 | 8/1977 | Bordelon | 222/402.11 X |
| 4,394,934 | 7/1983 | Fegley | 222/162 X |
| 5,242,349 | 9/1993 | Reiff et al. | 222/192 X |
| 5,370,407 | 12/1994 | Whalen | 280/809 |
| 5,446,985 | 9/1995 | Chen | 42/1.08 |
| 5,529,215 | 6/1996 | Banks et al. | 222/162 X |
| 5,673,436 | 10/1997 | Piper | 222/175 X |
| 5,709,635 | 1/1998 | Denison | 222/175 X |

OTHER PUBLICATIONS

Advanced Barrier System Brochure, printed before the invention of the present application.

Drawings from 08/959,202 previously filed by applicant.

*Primary Examiner*—Kenneth Bomberg

[57] ABSTRACT

This invention pertains to a hand held, thumb actuated irritant dispenser shaped like a night stick. The irritant dispenser comprises a cylindrical handle which is threadably affixed to a disposable cartridge containing a canister of pepper spray. The canister includes a nozzle which is oriented so that the pepper spray is dispensed along the longitudinal axis of the canister. An annular thumbar is electrically connected to a battery and a solenoid which selectively actuates the canister to dispense the pepper spray. A lock is included forming a part of the electrical circuit which helps increase the safety of the device around children.

20 Claims, 4 Drawing Sheets

IRRITANT DISPENSER AND METHOD

BACKGROUND OF THE INVENTION

1. Field of the Invention

This invention pertains to a portable irritant dispenser for protection and security purposes.

2. Description of the Prior Art and Objectives of the Invention

In recent years, crime levels have increased in all but a few cities. Of special concern to many individuals is the rise in violent crimes typified by assaults, robberies and break-ins. To combat the rising tide of crime a number of personal self-defense devices have become popular to deter assailants. Because many state statutes and even certain individuals frown on the use of lethal force, weapons such as handguns and knives are considered unacceptable modes of deterring assailants and non-lethal devices have proliferated. For night watchmen who are not allowed to carry a fire arm, non-lethal protection devices are especially useful.

Foremost among non-lethal devices are mace or pepper spray dispensers. These typically come in a variety of sizes, but generally all of the dispensers have a common shortcoming in that the nozzles resemble conventional aerosol nozzles and must be pointed in the desired direction. In the case of an aerosol nozzle which is generally cylindrically shaped with a radially aimed spray, aiming the nozzle in times of duress or stress, such as when under attack, can be quite difficult. There have been numerous reported incidents of people wielding mace or pepper spray against assailants only to spray themselves, rather than the assailant.

Another common device used by night watch men is a standard night stick. While several devices have disclosed combination tools and spray dispensers such as those found in U.S. Pat. Nos. 5,446,985, 5,370,407, 3,730,390 and Des. 334,790, these devices all have triggers which require specific orientations for personal defense. I.e., not only must the spray nozzle be pointed in the correct direction, but also the user must grasp the handle in a specific fashion to activate the spray. Likewise, these devices may look like a firearm which triggers an assault response in viewers. Sometimes, a viewer sees what he thinks is a gun; he panics and attacks with lethal weaponry or fierceness.

With the above concerns in mind, it is an objective of the present invention to provide an irritant spray dispenser, which has a fool proof, easy method of use.

It is a further objective of the present invention to provide a spray dispenser with a point and shoot arrangement, which can be actuated in any radial orientation while pointed at the assailant.

It is yet a further objective of the present invention to provide an irritant dispenser which is easily sized for use as a night stick.

It is still a further objective of the present invention to provide a spray dispenser that disperses pepper gas an effective range of 20 to 25 feet in a conical pattern.

It is another objective to provide an irritant dispenser with an electric actuating mechanism.

It is yet another objective to provide a spray dispenser with a lock to prevent inadvertent use by children or unauthorized persons.

It is still another objective to provide an irritant dispenser which requires only one handed operation.

It is a further objective to provide an irritant dispenser whose appearance is dissimilar to a firearm, thereby reducing the likelihood of triggering an assault response in nearby viewers.

It is yet a further objective to provide a thumb depressible 360 degree trigger which actuates the spray.

Other objectives and advantages of the invention will become apparent to those skilled in the art upon further reference to the detailed description below.

SUMMARY OF THE INVENTION

The aforesaid and other objectives are realized by an irritant dispenser which is shaped like a baton and easily used as an irritant dispenser or a night stick as needed. The irritant dispenser comprises an elongated, cylindrical handle which is threadably connected to a reusable or disposable cartridge. The cartridge contains a canister of irritant, preferably pepper spray, which is dispensed through a nozzle along the longitudinal axis of the cartridge upon selective depression of the nozzle. A spring biases the canister to prevent inadvertent dispersion of the irritant. The cartridge base defines an opening through which an actuating extension member may pass to actuate the canister within the cartridge. The cartridge is also preferably cylindrical and elongated as well as axially aligned with the handle.

The handle includes a set of interior threads which receive complementary threads on the cartridge. The handle also includes a thumbar, which encircles and is spaced from the threads. The thumbar is depressible at any location of its circular circumference, and upon such depression, it closes an electrical circuit by providing a short circuit across two beryllium copper contact strips. This completes a circuit from a conventional nine volt battery to a solenoid. The solenoid extends and forces an actuating extension member through the opening in the base of the cartridge to thereby actuate the same. A removable battery cover allows the battery to be replaced as needed.

As an additional safety feature, an electrical key lock is provided at the end of the handle opposite the threaded end. The lock allows an open circuit to be created in the circuit between the battery, solenoid and thumbar. A cap is provided which is attached to the handle by a flexible tether which covers and protects the lock from the inadvertent admission of moisture.

DETAILED DESCRIPTION OF THE PREFERRED EMBODIMENT AND OPERATION OF THE INVENTION

Figure 1:
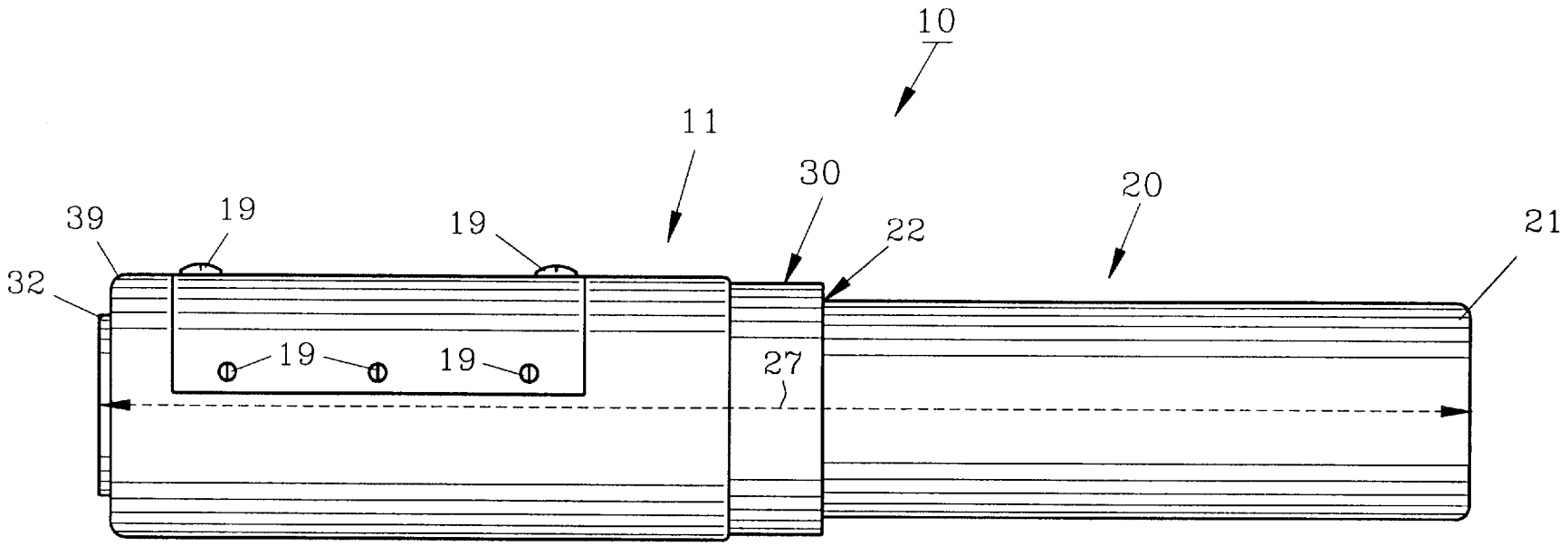
FIG. 1 shows a side elevational view of the preferred embodiment of the present invention.

Turning now to the drawings, specifically FIG. 1 shows preferred irritant dispenser 10 which includes handle 11 and cartridge 20. Cartridge 20 is essentially identical to the cartridge disclosed in my U.S. patent application Ser. No. 08/959,202 filed 28 Oct. 1997, now U.S. Patent No. , which is herein incorporated by reference. Irritant dispenser 10 forms dispensing end 21 and locking end 39 with longitudinal axis 27 extending therebetween. As is easily seen, cartridge 20 is axially aligned with handle 11 thereby forming a linear baton-like irritant dispenser.

Figure 2:
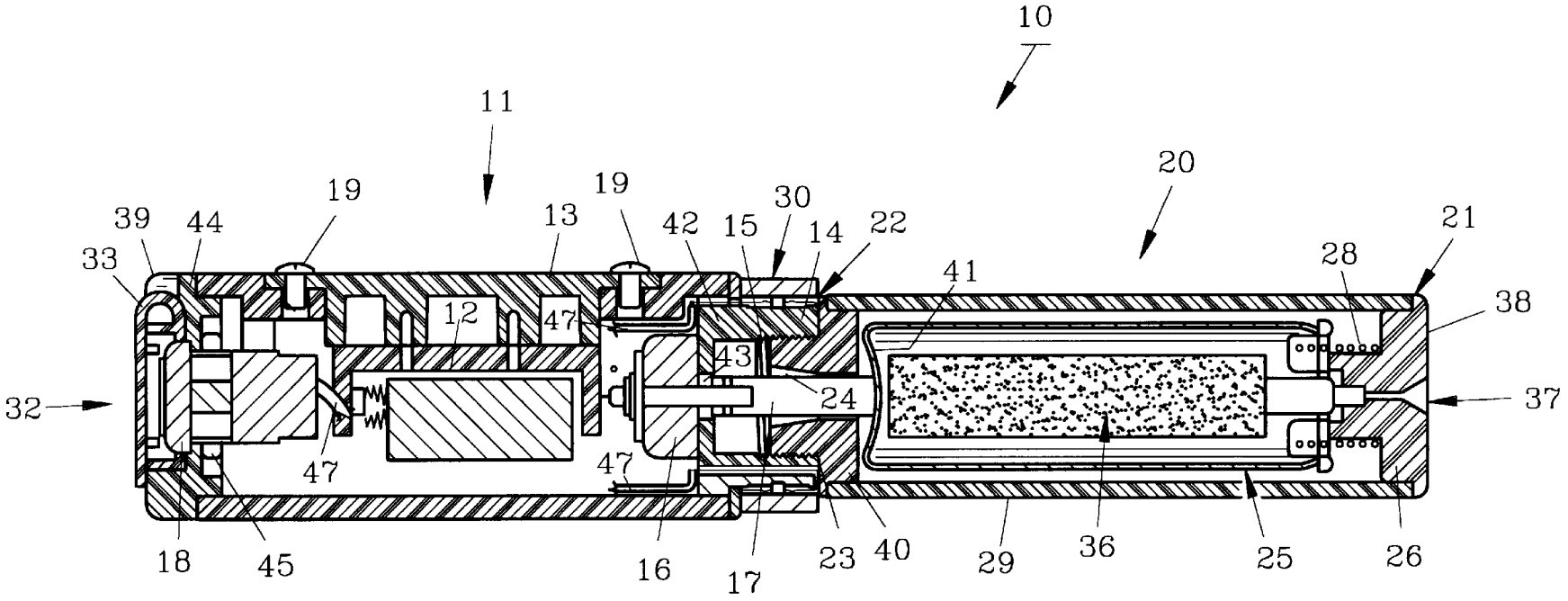
FIG. 2 illustrates a cross sectional view of the device of FIG. 1.

Cartridge 20, in FIG. 2, includes terminal end 38 and threaded end 22. Terminal end 38 is capped by nozzle 26 which is cemented or bonded to housing 29. Depression, or longitudinal compression, of nozzle 26 towards canister 25 actuates and dispenses irritant 36 from canister 25, through nozzle 26, out opening 37 generally along longitudinal axis 27 of irritant dispenser 10, but in a conical pattern. This is in contrast to conventional irritant dispensers which require the user to properly radially orient the irritant dispenser before activation since the irritant is dispersed perpendicular to the longitudinal axis of the dispenser. Movement of canister 25 within housing 29 towards dispensing end 21 effectuates the compression of nozzle 26 towards canister 25 since nozzle 26 is rigidly affixed to housing 29. To prevent inadvertent compression of nozzle 26, spring 28 biases nozzle 26 from canister 25. Canister 25 is preferably metallic, generally cylindrical and contains irritant 36 therein as is conventional. Opposite terminal end 38 of cartridge 20 is threaded end 22. Threaded end 22 includes threads 23 which are preferably integrally formed with thread cap 40. Thread cap 40 is cemented or bonded into cartridge 20 by conventional means. Threads 23 are preferably exterior threads and thread cap 40 defines opening 24 in the center thereof allowing access to bottom 41 of canister 25.

Figure 4:
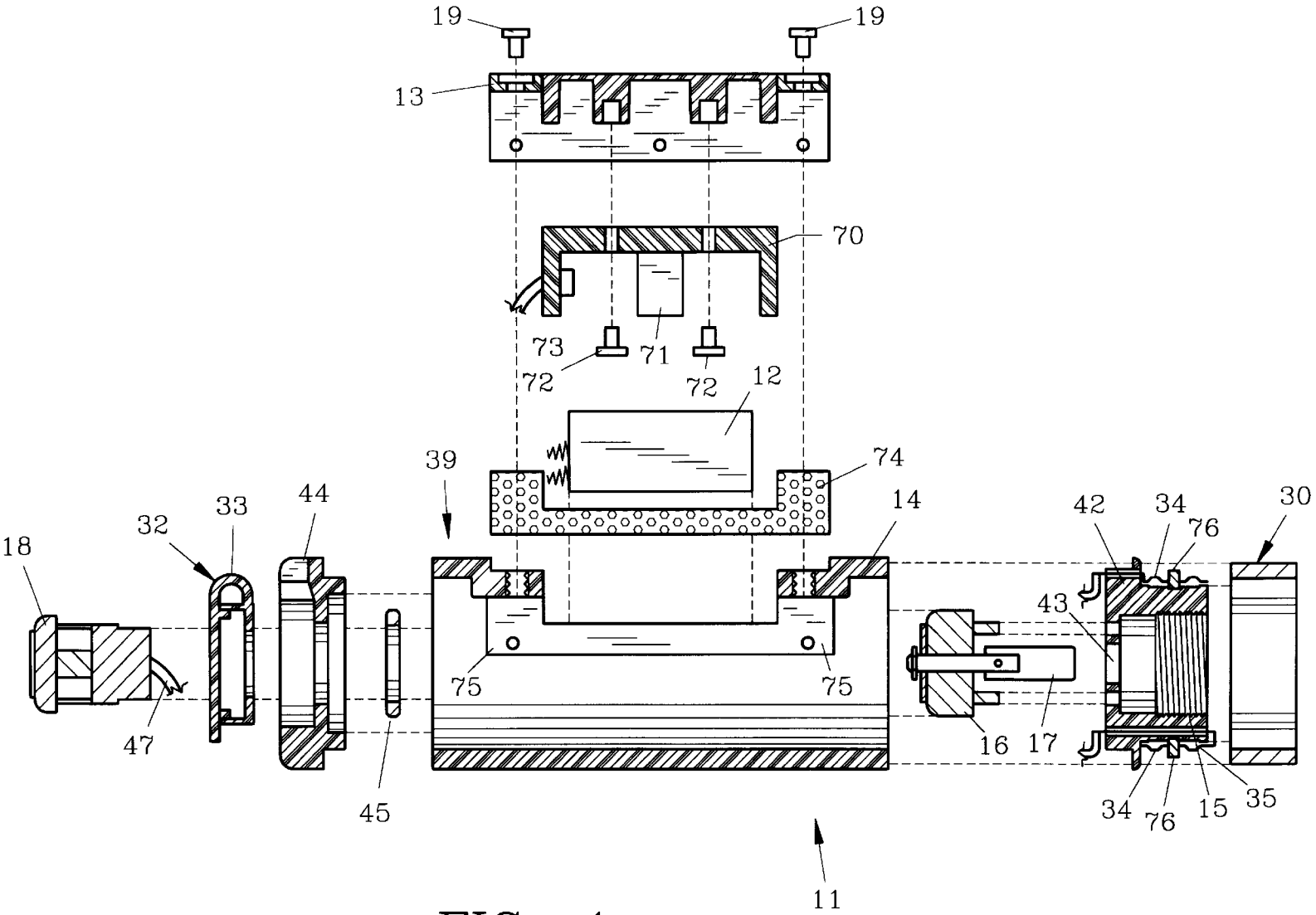
FIG. 4 features an exploded cross-sectional view of the handle of the device of FIG. 1.

Handle 11 is also seen in FIG. 2, and in exploded form in FIG. 4. Handle 11 includes locking end 39 and second threaded end 14, which is adapted to engage threads 23 of cartridge 20. Threaded end 14 includes interior threads 15 surrounded and formed by adapter 42. Adapter 42, which is cemented or bonded into threaded end 14, defines opening 43, which allows extension member 17 to pass therethrough. Extension member 17 is attached to conventional solenoid 16, and upon activation of solenoid 16, extension member 17 extends through both opening 43 and opening 24 and presses bottom 41 of canister 25. This compresses nozzle 26 and dispenses irritant 36.

Battery 12 is positioned inside handle 11 and is preferably a conventional nine volt battery. Battery cover 13 forms part of handle and is attached thereto by fasteners 19, such as screws. Attached to battery cover 13 by conventional fasteners 72 is battery case 70, which includes spring clip 71 depending therefrom. Spring clip 71 is preferably metal and sized to accommodate a conventional nine volt battery such as battery 12. Conventional nine volt battery connector 73 is also affixed to battery case 70 and attaches to battery 12 as is well understood. Seal 74 is a foam pad with an adhesive on its lower surface which can be applied to screw mount 75. Seal 74 provides a moisture tight environment for battery 12 and the associated electronics.

Figure 3:
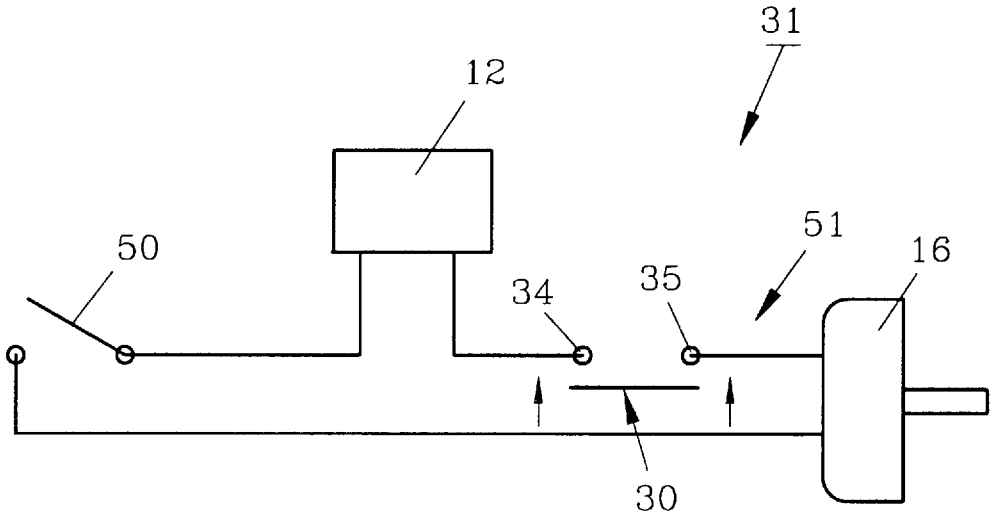
FIG. 3 demonstrates an electrical schematic of the electronic circuitry of the device of FIG. 1.

Locking end 39 is opposite complementary threaded end 14, which includes conventional electrical key lock 18. Key lock 18 fits within end piece 44 and is held in place by nut 45. End piece 44 is cemented or bonded to locking end 39 of handle 11. Lock 18 is protected by cap 32. Cap 32 includes flexible tether 33 which prevents cap 32 from being mislaid. Lock 18 performs a special function as seen in FIG. 3. Operation of lock 18 opens and closes switch 50 in electrical circuit 31. In one position, switch 50 creates an open circuit and current from battery 12 will not flow. However, when lock 18 is turned to the appropriate position, switch 50 is closed and the circuit is complete. As also seen in FIG. 3, circuit 31 includes solenoid 16 and thumbar switch 51. Switch 50 must be in the closed position and thumbar switch 51 must be depressed before irritant 36 may be dispersed in normal operation.

Returning to FIGS. 2 and 4, surrounding adapter 42 is first beryllium copper contact strip 34 which is electrically connected to solenoid 16. Second beryllium copper contact strip 35 is spaced from first strip 34 by foam insulator ring 76. Contact strips 34 and 35 are preferably conventional 0.008 inch (0.02 cm) thick finger strips. The finger strip arrangement provides some resiliency in contact strips 34 and 35. Spaced 1/32 inch (0.08 cm) from strips 34 and 35 is stainless steel thumbar 30. Thumbar 30 comprises an electric actuator for irritant dispenser 10 and is in the shape of an annular ring which fits over adapter 42. Adapter 42 in turn is cemented or bonded to handle 11 at threaded end 14. The method of use allows a user to depress thumbar 30 with a single digit, such as a thumb (not shown) and thereby close the open circuit shown generally as thumbar switch 51 in FIG. 3. A user may grasp handle 11 and turn lock 18 to the active position thereby "arming" irritant dispenser 10. The user points dispensing end 21 at an assailant and depresses thumbar 30. Thumbar 30 closes thumbar switch 51 to thereby trigger solenoid 16. Solenoid 16 moves approximately one-eighth inch (0.32 cm) with approximately one pound of thrust and pushes extension member 17 through openings 43 and 24 against bottom 41 of canister 25, thereby depressing nozzle 26. This depression actuates and dispenses irritant 36 through nozzle 26 and out opening 37 at the assailant. The advantage of this arrangement is that irritant dispenser 10 may have any circumferential placement in the user's hand. That is, there is no "top" as in conventional aerosol irritant dispensers which must be pointed upwardly and in the correct radial direction for irritant dispenser 10 to work; the user merely needs to point dispensing end 21 at the assailant and press thumbar 30 at any point along its circumference. This eliminates unnecessary "fumbling" in a stress filled situation, as the user attempts to point irritant dispenser 10 at the assailant.

While irritant dispenser 10 is preferably formed from a polymeric material such as polyvinyl chloride, other materials can be used such as metal. Metal is not preferred because it may be electrically conductive. Soft, rounded edges are also preferred at corners, because in the event that irritant dispenser 10 is used as a club or night stick, sharp edges may unnecessarily aggravate any injuries inflicted. As an additional safety precaution, thumbar 30 has an outer diameter that is less than the outer diameter of handle 11; this allows irritant dispenser 10 to be placed on a planar surface such as a table or car seat without fear of accidentally depressing thumbar 30 since it will be elevated from the surface by handle 10.

The preceding recitation is provided as an example of the preferred embodiment and is not meant to limit the nature of scope of the present invention or appended claims.

I claim:

1. An irritant dispenser comprising:

a) a cartridge, said cartridge comprising:

i) a canister;

ii) a nozzle, said nozzle contiguous said canister, said nozzle defining an opening;

iii) an irritant, said irritant disposed within said canister, said irritant selectively dispensable through said nozzle, along the longitudinal axis of said canister;

b) a handle, said handle contiguous said cartridge; and c) an electrical actuator, said actuator for actuating said cartridge to dispense said irritant, said actuator contiguous said handle.

2. The irritant dispenser of claim 1 wherein said cartridge is threadably affixed to said handle.

3. The irritant dispenser of claim 1 further comprising a battery, said battery electrically connected to said actuator.

4. The irritant dispenser of claim 3 further comprising a solenoid, said solenoid electrically connected to said battery.

5. The irritant dispenser of claim 4 wherein said solenoid will selectively actuate said cartridge.

6. The irritant dispenser of claim 3 further comprising a battery cover plate, said cover plate contiguous said handle.

7. The irritant dispenser of claim 1 wherein said handle is cylindrical and elongated.

8. The irritant dispenser of claim 1 wherein said cartridge is cylindrical.

9. The irritant dispenser of claim 1 wherein said actuator comprises a thumbar, said thumbar comprising an annular ring, said annular ring circumscribing said handle.

10. The irritant dispenser of claim 1 in the form of a night stick.

11. The irritant dispenser of claim 1 further comprising a lock, said lock electrically connected to said electrical actuator, said lock for selectively enabling the actuation of said cartridge.

12. An irritant dispenser comprising:

a) a handle;

b) a cartridge, said cartridge affixed to said handle;

c) a battery, said battery positioned within said handle;

d) an irritant, said irritant disposed within said cartridge; and e) an actuator, said actuator electrically connected to said battery, whereby activating said actuator selectively dispenses said irritant.

13. The irritant dispenser of claim 12 further comprising a canister, said canister disposed within said cartridge.

14. The irritant dispenser of claim 12 wherein said actuator comprises a thumbar.

15. The irritant dispenser of claim 14 further comprising a solenoid, said solenoid electrically connected to said battery, whereby said solenoid actuates upon depression of said thumbar.

16. The irritant dispenser of claim 12 wherein said cartridge comprises a nozzle, said nozzle for selectively dispensing said irritant therethrough along the longitudinal axis of said handle.

17. The irritant dispenser of claim 16 wherein said nozzle is depressible.

18. The irritant dispenser of claim 17 further comprising a solenoid, said solenoid electrically connected to said battery, said solenoid for selectively depressing said nozzle upon activation of said actuator.

19. The irritant dispenser of claim 12 wherein said handle and said cartridge are axially aligned.

20. A method of dispensing an irritant from an irritant dispenser containing an irritant cartridge and an electrical actuator, said method comprising the steps of:

a) aiming the irritant dispenser in a desired direction;

b) depressing the electrical actuator on said irritant dispenser; and c) dispensing the irritant from the cartridge.

* * * * *